US008534313B1

(12) United States Patent
Achterman

(10) Patent No.: US 8,534,313 B1
(45) Date of Patent: Sep. 17, 2013

(54) TOILET FILL VALVE AUXILIARY SHUTOFF MECHANISM

(71) Applicant: Kermit L. Achterman, La Canada Flintridge, CA (US)

(72) Inventor: Kermit L. Achterman, La Canada Flintridge, CA (US)

( * ) Notice: Subject to any disclaimer, the term of this patent is extended or adjusted under 35 U.S.C. 154(b) by 0 days.

(21) Appl. No.: 13/734,717

(22) Filed: Jan. 4, 2013

Related U.S. Application Data

(60) Provisional application No. 61/682,121, filed on Aug. 10, 2012.

(51) Int. Cl.

| | |
|---|---|
| ***F16K 21/18*** | (2006.01) |
| ***F16K 31/20*** | (2006.01) |
| ***F16K 31/26*** | (2006.01) |
| ***F16K 31/18*** | (2006.01) |
| ***F16K 35/00*** | (2006.01) |
| ***E03D 1/00*** | (2006.01) |
| ***E03D 1/24*** | (2006.01) |
| ***E03D 11/02*** | (2006.01) |
| ***E03D 11/18*** | (2006.01) |

(52) U.S. Cl.
USPC ..... 137/389; 137/400; 137/434; 251/91; 4/314; 4/331; 4/427

(58) Field of Classification Search
USPC ..... 137/389, 391, 392, 400, 409, 434, 137/436, 441, 445, 448; 251/68, 89–116; 4/314, 331, 427
See application file for complete search history.

(56) References Cited

U.S. PATENT DOCUMENTS

| | | | | |
|---|---|---|---|---|
| 5,247,710 | A * | 9/1993 | Carder et al. | 4/508 |
| 6,058,519 | A * | 5/2000 | Quintana | 4/427 |
| 6,178,569 | B1 * | 1/2001 | Quintana | 4/427 |
| 8,166,996 | B2 * | 5/2012 | Canfield et al. | 137/389 |
| 2004/0199989 | A1 * | 10/2004 | Trolio | 4/427 |

* cited by examiner

*Primary Examiner* — Craig Schneider
*Assistant Examiner* — Hailey K Do
(74) *Attorney, Agent, or Firm* — QuickPatents; Kevin Prince

(57) ABSTRACT

An auxiliary actuator for a toilet fill valve comprises a plunger oriented under an arm of the toilet fill valve to lift the arm to close the toilet fill valve when the plunger is in a raised position. A spring or hydraulic mechanism urges the plunger into the raised position. A solenoid mechanism is normally de-energized and engages a latching mechanism of the plunger when the plunger is in a lowered position. An electronic sensing circuit has at least one sensor and a power source. The electronic sensing circuit is electrically connected with the solenoid mechanism to energize the solenoid mechanism upon detection of a fault condition based on the input of the at least one sensor. Fault conditions may include a flush valve leak, a stuck-open flush valve, a plugged toilet, and a leaking fill valve.

18 Claims, 7 Drawing Sheets

TOILET FILL VALVE AUXILIARY SHUTOFF MECHANISM

CROSS-REFERENCE TO RELATED APPLICATIONS

This application claims the benefit of U.S. Provisional Patent Application 61/682,121, filed on Aug. 10, 2012, and incorporated herein by reference.

STATEMENT REGARDING FEDERALLY SPONSORED RESEARCH AND DEVELOPMENT

Not Applicable.

FIELD OF THE INVENTION

This invention relates to valve actuators, and more particularly to a toilet fill valve shutoff mechanism.

DISCUSSION OF RELATED ART

Conventional toilet fill valves include a fill valve float mechanism that lifts an arm in response to a rising water level in a toilet tank. The arm closes the toilet fill valve when lifted by the fill valve float mechanism. Such prior art valves, and other toilet components, are prone to frequent failure. For example, when a toilet becomes "plugged" due to an obstruction in the toilet drain, flushing of the toilet may result in overflow of the toilet bowl and subsequent property damage to the surrounding area. Prior art toilet valves do not provide for shutting the water supply off when a high-level condition in a toilet bowl is detected, which would be beneficial for reducing property damage.

Further, prior art toilet fill valves may leak, that is, not completely shut off when the water level in the toilet tank reaches the "full" water level position within the tank. As such, the water level in the tank can reach a high-level where water either continuously drains down an auxiliary drain if the toilet includes such a provision, or water could overflow the toilet tank and again result in property damage.

The prior art flush valve in a toilet is also prone to frequent failures. In one instance, the flush valve may become "stuck open" whereby the fill valve runs continuously because the water level in the tank is never able to rise. As a result, a significant amount of water may be wasted while such a valve is stuck open. Moreover, such prior art flush valves may leak, which results in the water level in the tank slowly lowering until the float reaches a point that it opens the fill valve. As the fill valve typically introduces water into the tank at a faster rate than such a leaky flush valve leaks water, the water level in the tank rises to the point where the float shuts off the fill valve. But the flush valve continues to leak, and a repeating cycle of filling the tank ensues, again resulting in a significant waste of water and greater expense to the property owner. None of the prior art toilet fill valves provides for detecting either of these flush valve fault conditions to shut-off the water and prevent waste thereof.

Therefore, there is a need for a device that can detect a toilet bowl high water level fault, a toilet tank high water level fault, a "stuck open" flush valve, and a leaky flush valve and shut-off the toilet fill valve accordingly. Such a needed device would be relatively easy to affix to prior art fill valves, and would be relatively easy to install on a conventional toilet. Such a needed device would further provide means for alerting a user as to the fault condition. The present invention accomplishes these objectives.

SUMMARY OF THE INVENTION

The present invention is an auxiliary actuator for a toilet fill valve of the type having a fill valve float mechanism that lifts an arm in response to a rising water level in a toilet tank. The arm closes the toilet fill valve when lifted by the fill valve float mechanism, as is known in the art.

The auxiliary actuator comprises a plunger slidably and vertically oriented under the arm of the toilet fill valve to lift the arm sufficient to close the toilet fill valve when the plunger is in a raised position. A biasing means urges the plunger into the raised position.

A solenoid mechanism is normally de-energized and adapted to engage a latching mechanism of the plunger when the plunger is in a lowered position. The solenoid mechanism when energized disengages from the latching mechanism to allow the plunger to be urged into the raised position by the biasing means.

An electronic sensing circuit is included that has at least one sensor and a power source. The electronic sensing circuit is electrically connected with the solenoid mechanism to energize the solenoid mechanism upon detection of a fault condition based on the input of the at least one sensor. The electronic sensing circuit may further include a control module that has a circuit board, a reset switch, a mode selector switch, an audible warning device, and at last one LED indicator. As such, the audible warning device and/or the at least one LED indicator may be energized by the electronic sensing circuit to alert a user to the fault condition. The control module may further include an external port, such that the electronic sensing circuit may set an indication of a type of fault condition thereon. As such, an external alarm system connected to the external port may be utilized to alert a user to the fault condition.

The at least one sensor may be a water level sensor for sensing the water level in the toilet tank. The electronic sensing circuit may be programmed to detect a slow leak in the flush valve of the toilet tank by observing over a predetermined period of time a repeating pattern of the water level decreasing relatively slowly compared with a regular flush of the toilet, and then increasing as the fill valve refills the toilet tank. As such a fault condition is established and the electronic sensing circuit energizes the solenoid mechanism to essentially "turn off" the toilet until the slow leak in the flush valve is fixed. Further, the at least one LED indicator may be energized to indicate a slow flush valve leak, or an indication of such a fault condition may be transmitted by the wireless transmitter or otherwise conveyed to the external alarm system. The electronic sensing circuit may be further programmed to detect a stuck-open flush valve by observing a continuous low water level in the toilet tank. The electronic sensing circuit may be further programmed to detect a leaking fill valve by observing a continuous high water level in the toilet tank.

The at least one sensor may be a water level sensor for sensing the water level in a toilet bowl, and the electronic sensing circuit may be programmed to detect a "plugged toilet" fault condition by observing a high water level in the toilet bowl.

In an alternate embodiment the biasing means is a hydraulic mechanism powered by water pressure from the toilet fill valve. In such an embodiment, a solenoid operated valve normally is de-energized and is adapted to block water pressure from the toilet fill valve from raising the plunger. The solenoid operated valve, when energized because of the detection of a fault, allows water pressure from the toilet fill valve to raise the plunger to close the toilet fill valve.

The present invention is a device that detects a toilet bowl high water level fault, a toilet tank high water level fault, a "stuck open" flush valve, and a leaky flush valve and shuts-off the toilet fill valve accordingly. The present invention is relatively easy to affix to prior art toilet fill valves, and is relatively easy to install on a conventional toilet. The present device further provides means for alerting a user as to the fault condition. Other features and advantages of the present invention will become apparent from the following more detailed description, taken in conjunction with the accompanying drawings, which illustrate, by way of example, the principles of the invention.

DESCRIPTION OF THE DRAWINGS

The objects and features of the present invention which are believed to be novel, are set forth with particularity in the appended claims. This present invention, both as to its organization and manner of operation, together with further description, taken in conjunction with accompanying drawings in which:

DETAILED DESCRIPTION OF THE PREFERRED EMBODIMENT

Figure 1:
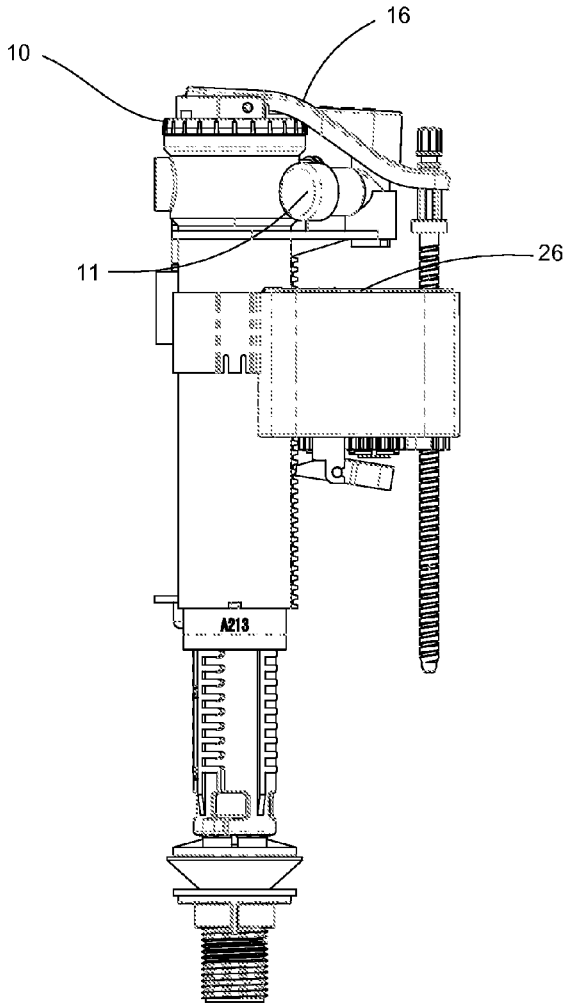
FIG. 1 is a front perspective view showing a prior art toilet fill valve with the actuation mechanism of the present invention attached and integrated therewith.
Figure 2:
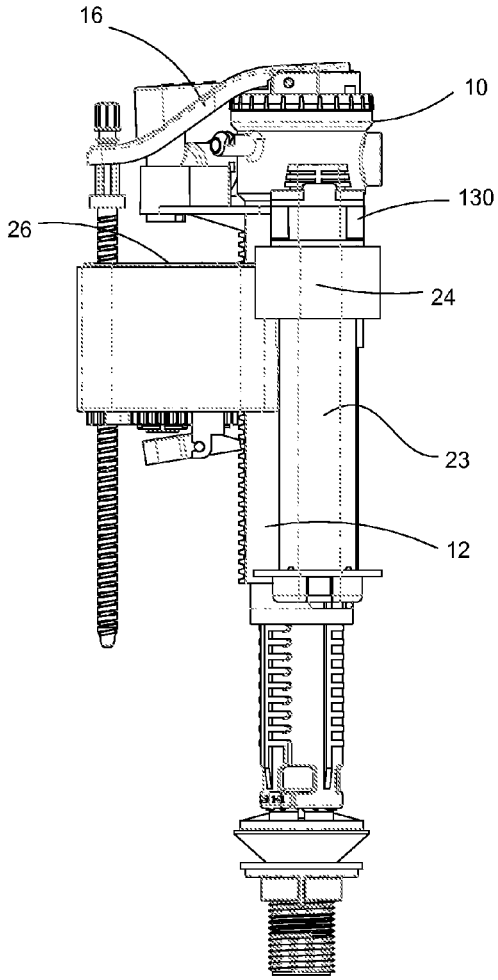
FIG. 2 is a rear perspective of FIG. 1.

Illustrative embodiments of the invention are described below. The following explanation provides specific details for a thorough understanding of and enabling description for those embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the word "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

FIGS. 1-5 illustrate an auxiliary actuator 11 for a toilet fill valve 10 of the type having a fill valve float mechanism 26 that lifts an arm 16 in response to a rising water level 8 in a toilet tank 9. The arm 16 closes the toilet fill valve 10 when lifted by the fill valve float mechanism 26.

Figure 4:
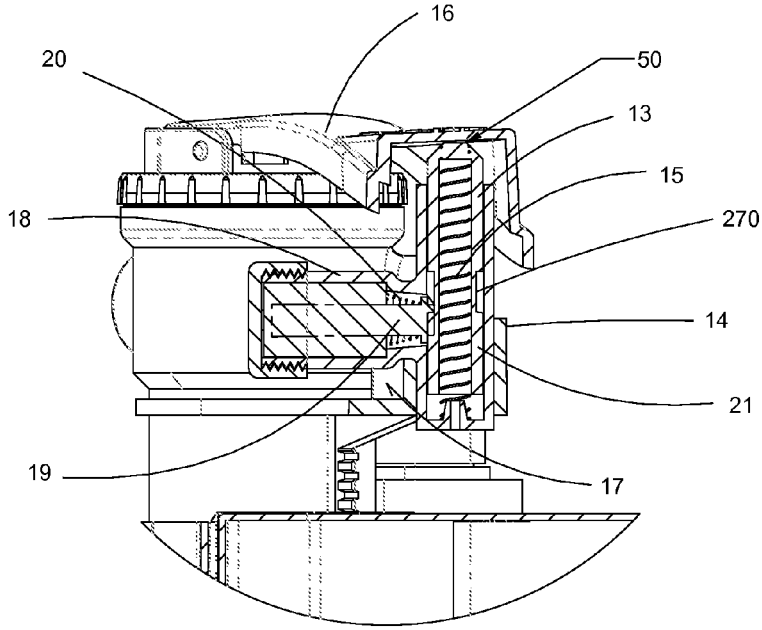
FIG. 4 is a cross-sectional view of FIG. 1 showing the fill valve closed.
Figure 5:
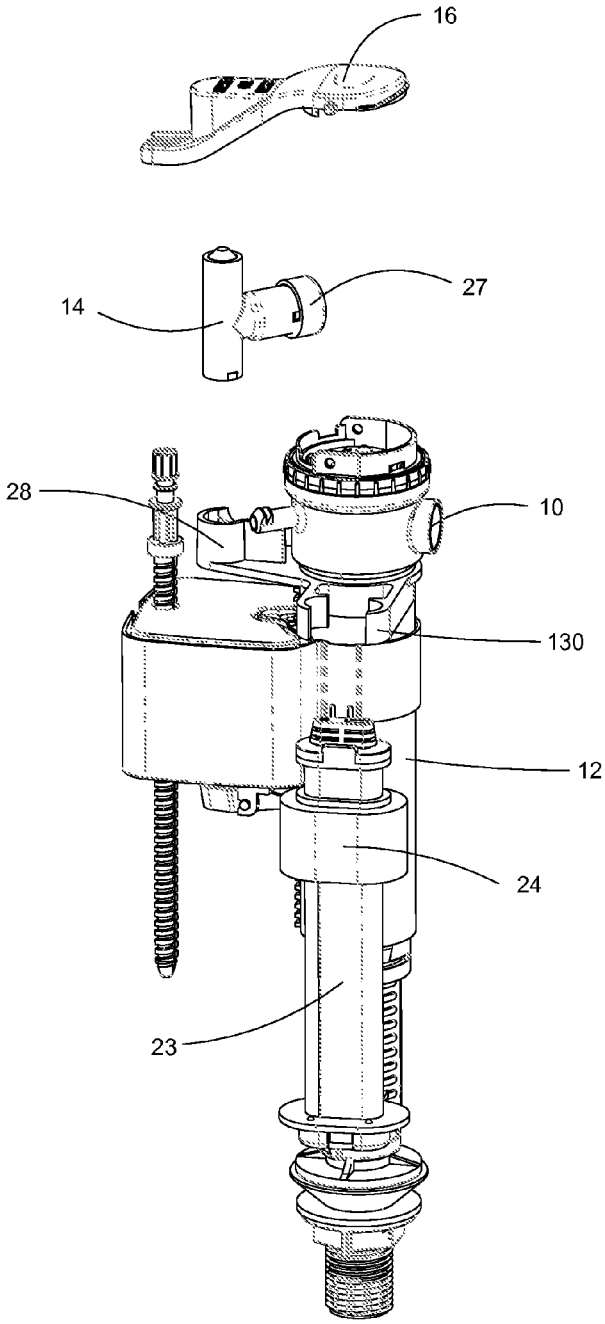
FIG. 5 is an exploded perspective view of the actuator mechanism of FIG. 1.

The auxiliary actuator 11 comprises a plunger 13 slidably and vertically oriented under the arm 16 of the toilet fill valve 10 to lift the arm 16 sufficient to close the toilet fill valve 10 when the plunger 13 is in a raised position 50. A biasing means 15 urges the plunger into the raised position 50 (FIG. 4).

Figure 3:
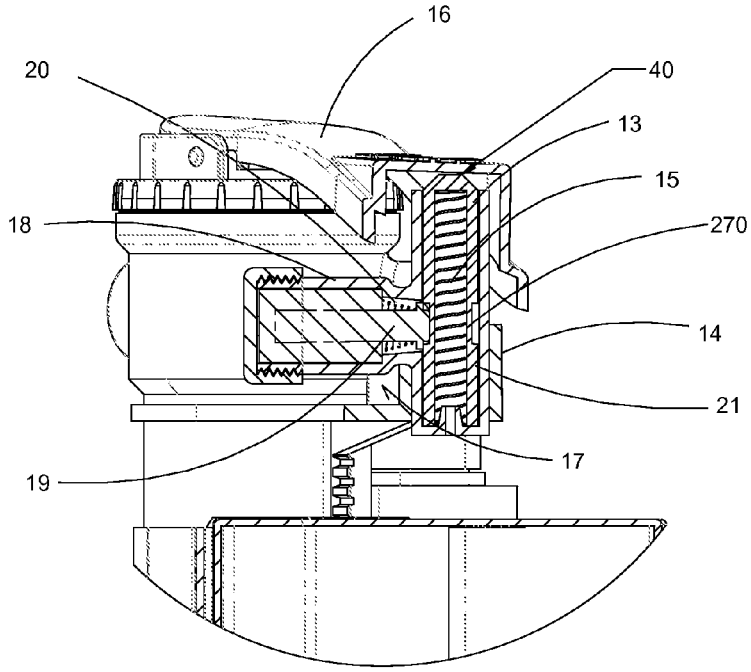
FIG. 3 is a cross-sectional view of FIG. 1 showing the fill valve open.

A solenoid mechanism 18 is normally de-energized and adapted to engage a latching mechanism 17 of the plunger 13 when the plunger 13 is in a lowered position 40 (FIG. 3). The solenoid mechanism 18 when energized disengages from the latching mechanism 17 to allow the plunger 13 to be urged into the raised position 50 by the biasing means 15.

The plunger 13 is preferably contained in a plunger housing 14. The biasing means 15, such as a spring, is positioned below the plunger 13 and oriented to push the plunger 13 upwards against the underside of the float arm 16. The latching mechanism 17 may include a circumferential groove. A solenoid mechanism 18 is positioned within a solenoid housing 27 such that a solenoid armature 19 engages the circumferential groove 270 of the plunger 13. The solenoid armature 19 is biased against the circumferential groove 270 of the plunger 13 by a solenoid armature spring 20. In one embodiment, the plunger housing 14 and the solenoid housing 27 are positioned in a mounting bracket 28 and attached to the commercially available fill valve 10.

The plunger 13 preferably has a beveled end 21 so that when it is manually pushed downward, the beveled end 21 pushes against the solenoid armature 19, causing it to retract. When the plunger 13 is manually pushed down to a position where the circumferential groove 270 aligns with the solenoid armature 19, the solenoid armature 19 is then pushed forward by the solenoid armature spring 20 to engage the circumferential groove 270 of the plunger 13, thus preventing the plunger 13 moving to its raised position 50 under the influence of the biasing means 15. When the solenoid 18 receives a signal from the electronic sensing circuit 60 it retracts, withdrawing the solenoid armature 19 from the circumferential groove 270 of the plunger 13. This allows the biasing means 15 to push the plunger 13 upwards against the float arm 16, causing the fill valve 10 to close as though the fill valve float mechanism 26 had raised in response to the rising water level 8 in the toilet tank 9. Once the plunger 13 has been released and the fill valve 10 is closed, it must be reset manually by pushing downward on the float arm 16 until the solenoid armature 19 re-engages the circumferential groove 270 of the plunger 13.

An electronic sensing circuit 60 is included that has at least one sensor 12 and a power source 70, such as a battery, AC adapter 72, or the like. The electronic sensing circuit 60 is electrically connected with the solenoid mechanism 18 to energize the solenoid mechanism 18 upon detection of a fault condition based on the input of the at least one sensor 12.

Figure 7:
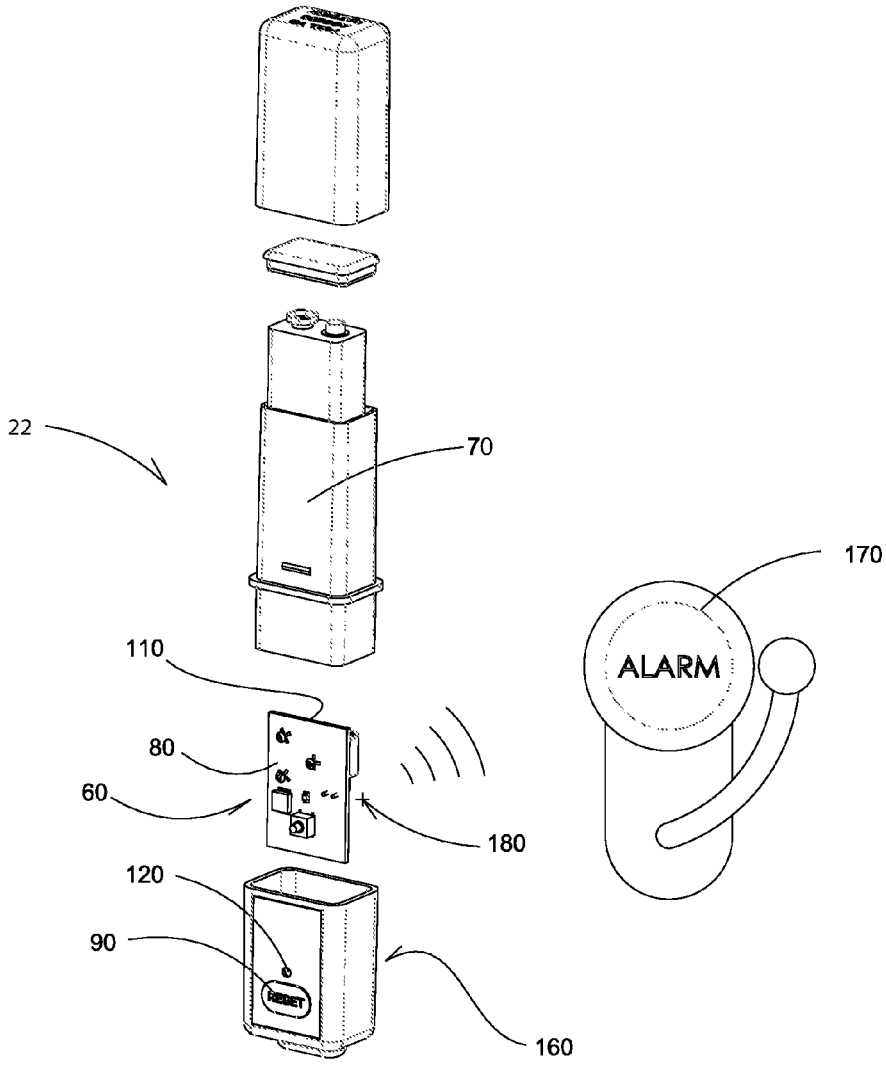
FIG. 7 is a perspective diagram of a control module of the present invention and an external alarm system.

The electronic sensing circuit 60 may further including a control module 22 that has a circuit board 80 (FIG. 7), a reset switch 90, a mode selector switch 100, an audible warning device 110, and at last one LED indicator 120. As such, the audible warning device 110 and the at least one LED indicator 120 may be energized by the electronic sensing circuit 60 to alert a user to the fault condition.

The control module 22 may further include an external port 160, such that the electronic sensing circuit 60 may set an indication of a type of fault condition thereon. As such, an external alarm system 170 connected to the external port 160 may be utilized to alert a user to the fault condition. The control module 22 may include a wireless transmitter 180 for wirelessly transmitting an indication of the fault condition to the external alarm system 170. Such an external alarm system may be a dedicated alarm system located remotely from the toilet and having access to a power source, or it may be alternately incorporated into a computer software application through a wireless networking protocol such as Wi-Fi, Bluetooth, or the like.

The at least one sensor 12 may be a water level sensor 130 for sensing the water level 8 in the toilet tank 9. Such a water level sensor 130 may include, for example, a body 23 and a float 24. The sensor 130 may further include any type of electronic sensing device such as a series of reed switches, a linear potentiometer, a linear variable differential transformer (LVDT), a magnetostrictive transducer, or other mechanism for sensing the position of the float 24 on the body 23.

The electronic sensing circuit 60 may be programmed to detect a slow leak in the flush valve (not shown) of the toilet tank 9 by observing over a predetermined period of time a repeating pattern of the water level 8 decreasing relatively slowly compared with a regular flush of the toilet, and then increasing as the fill valve 10 refills the toilet tank 9. As such a fault condition is established and the electronic sensing circuit 60 energizes the solenoid mechanism 18 to essentially "turn off" the toilet until the slow leak in the flush valve is fixed. Further, the at least one LED indicator 120 may be energized to indicate a slow flush valve leak, or an indication of such a fault condition may be transmitted by the wireless transmitter 180 or otherwise conveyed to the external alarm system 170.

The at least one sensor 12 may be the water level sensor 130 for sensing the water level in the toilet tank 9 as above, and the electronic sensing circuit 60 may be further programmed to detect a stuck-open flush valve by observing a continuous low water level 140 in the toilet tank 9. As such a fault condition may be established and the electronic sensing circuit 60 may energize the solenoid mechanism 18 to essentially "turn off" the toilet until the stuck-open flush valve condition is fixed. Further, the at least one LED indicator 120 may be energized to indicate a stuck-open flush valve condition, or an indication of such a fault condition may be transmitted by the wireless transmitter 180 or otherwise conveyed to the external alarm system 170.

Figure 6:
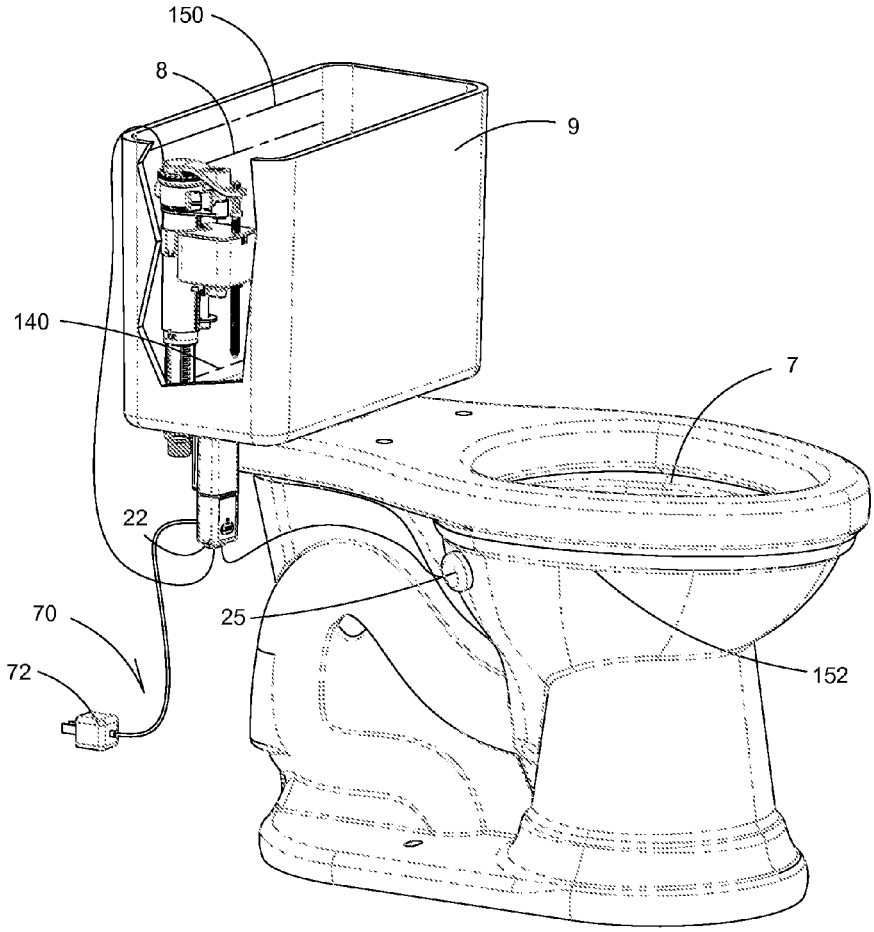
FIG. 6 is an installation drawing showing the invention installed in a typical toilet.

The at least one sensor 12 may be a water level sensor 25 (FIG. 6) for sensing the water level in a toilet bowl 7. The toilet bowl water level sensor 25 may be one or more float switches (not shown), a capacitive type sensor (not shown), or any other suitable type of water level sensor. The electronic sensing circuit 60 may be programmed to detect a toilet bowl high water level fault by observing a high water level 152 in the toilet bowl 7. As such a fault condition may be established and the electronic sensing circuit 60 may energize the solenoid mechanism 18 to essentially "turn off" the toilet until the "plugged toilet" condition is fixed. Further, the at least one LED indicator 120 may be energized to indicate a plugged toilet condition, or an indication of such a fault condition may be transmitted by the wireless transmitter 180 or otherwise conveyed to the external alarm system 170.

The at least one sensor 12 may be the water level sensor 130 for sensing the water level 8 in the toilet tank 9 as above, and the electronic sensing circuit 60 may be further programmed to detect a leaking fill valve 10 by observing a continuous high water level 150 in the toilet tank 9. As such a fault condition may be established and the electronic sensing circuit 60 may energize the solenoid mechanism 18 to essentially "turn off" the toilet until the leaking fill valve condition is fixed. Further, the at least one LED indicator 120 may be energized to indicate a leaking fill valve condition, or an indication of such a fault condition may be transmitted by the wireless transmitter 180 or otherwise conveyed to the external alarm system 170.

Figure 8:
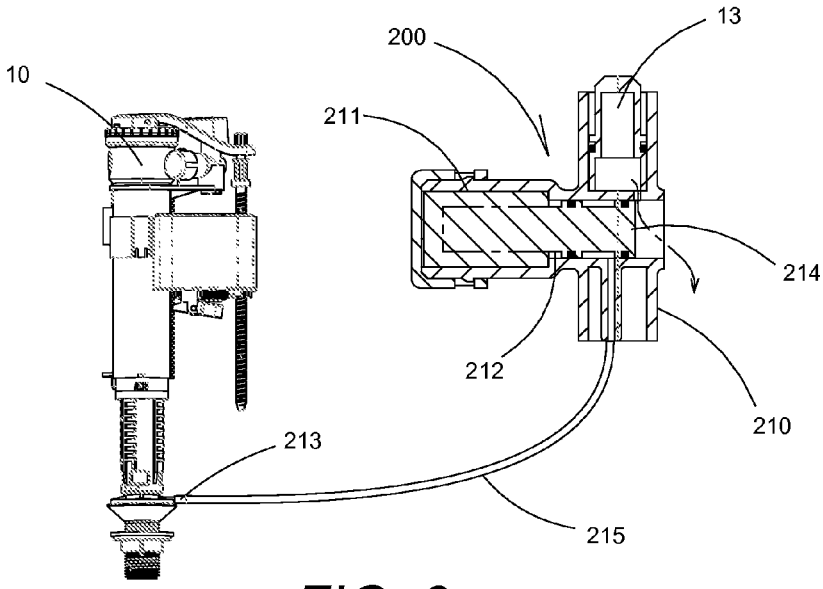
FIG. 8 is a cross-sectional view of an alternate embodiment of the invention that includes a hydraulic mechanism powered by water pressure from the toilet fill valve and a solenoid operated valve, the toilet valve in an open position.

FIG. 8 shows an alternate embodiment where the biasing means 15 is a hydraulic mechanism 200 powered by water pressure from the toilet fill valve 10. In such an embodiment a solenoid operated valve 210 normally is de-energized and is adapted to block water pressure from the toilet fill valve 10 from raising the plunger 13 to close the toilet fill valve 10. The solenoid mechanism 211 shown in this embodiment is a "push type" as opposed to a "pull type" shown previously as item #18, although either type may be utilized. FIG. 8 shows the solenoid 211 de-energized and the valve spool 214 in its normal position blocking the water pressure from the pressure tap 213 in the toilet fill valve 10. Water pressure is obtained from the toilet fill valve 10 by means of a hose 215, or other water passage connected from the inlet side of the toilet fill valve 10.

Figure 9:
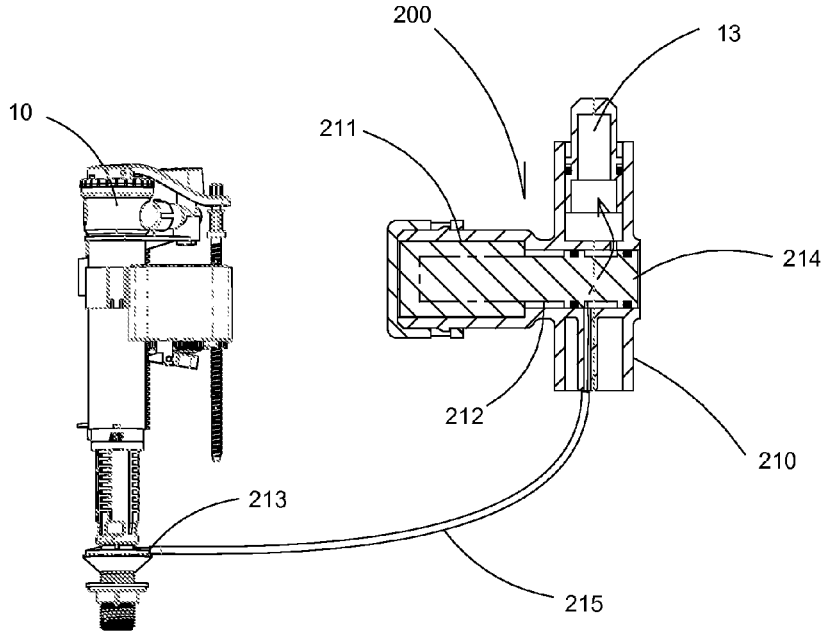
FIG. 9 is a cross-sectional view of FIG. 8, but showing the toilet valve in a closed position.

FIG. 9 shows the alternative embodiment when a fault condition has been established by the electronic sensing circuit 60 and a signal has been sent to the solenoid 211, causing it to be energized. The solenoid armature 212 extends, pushing the valve spool 214 to the right, directing water pressure from the pressure tap 213 in the toilet fill valve 10 into the area below the plunger 13, causing it raise, lifting the float lever arm 16 and shutting off the toilet fill valve 10.

The alternate embodiment hydraulic mechanism may be reset manually by pushing the valve spool 214 back to its normal position and then pushing the plunger 13 downward, expelling the water from beneath it.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An auxiliary actuator for a toilet fill valve of the type having a fill valve float mechanism that lifts an arm in response to a rising water level in a toilet tank, the arm closing the toilet fill valve when lifted by the fill valve float mechanism, the auxiliary actuator comprising:

a plunger slidably and vertically oriented under the arm of the toilet fill valve to lift the arm sufficiently to close the toilet fill valve when the plunger is in a raised position, a biasing means urging the plunger into the raised position;

a solenoid mechanism normally de-energized and adapted to engage a latching mechanism of the plunger when the plunger is in a lowered position, the solenoid mechanism when energized disengaging from the latching mechanism to allow the plunger to be urged into its raised position by the biasing means; and an electronic sensing circuit including at least one sensor and a power source, the electronic sensing circuit electrically connected with the solenoid mechanism to energize the solenoid mechanism upon detection of a fault condition based on the input of the at least one sensor.

2. The auxiliary actuator of claim 1 wherein the electronic sensing circuit further includes a control module, a circuit board, a reset switch, an audible warning device, and at least one LED indicator, whereby the audible warning device and the at least one LED indicator may be energized by the electronic sensing circuit to alert a user to the fault condition.

3. The auxiliary actuator of claim 1 wherein one of the at least one sensors is a water level sensor for sensing the water level in the toilet tank, the electronic sensing circuit programmed to detect a slow flush valve leak by observing over a predetermined period of time a repeating pattern of the water level decreasing relatively slowly compared with a regular flush of the toilet, and then increasing as the fill valve refills the toilet tank, whereby a fault condition is established and the electronic sensing circuit energizes the solenoid mechanism.

4. The auxiliary actuator of claim 1 wherein one of the at least one sensors is a water level sensor for sensing the water level in the toilet tank, the electronic sensing circuit programmed to detect a stuck-open flush valve by observing a continuous low water level in the toilet tank, whereby a fault condition is established and the electronic sensing circuit energizes the solenoid mechanism.

5. The auxiliary actuator of claim 1 wherein one of the at least one sensors is a water level sensor for sensing the water level in a toilet bowl, the electronic sensing circuit programmed to detect a toilet bowl high water level fault by observing a high water level in the toilet bowl, whereby a fault condition is established and the electronic sensing circuit energizes the solenoid mechanism.

6. The auxiliary actuator of claim 1 wherein one of the at least one sensors is a water level sensor for sensing the water level in the toilet tank, the electronic sensing circuit programmed to detect a high water level fault by observing a continuous high water level in the toilet tank, whereby a fault condition is established and the electronic sensing circuit energizes the solenoid mechanism.

7. The auxiliary actuator of claim 2 wherein the control module further includes an external port, and wherein the electronic sensing circuit is adapted to set an indication of the type of fault condition on the external port, whereby an external alarm system connected to the external port may be utilized to alert a user to the fault condition.

8. The auxiliary actuator of claim 7 wherein the external port includes a wireless transmitter for wirelessly transmitting an indication of the fault condition to an external alarm system.

9. The auxiliary actuator of claim 1 wherein the biasing means is a spring.

10. An auxiliary actuator for a toilet fill valve of the type having a fill valve float mechanism that lifts an arm in response to a rising water level in a toilet tank, the arm closing the toilet fill valve when lifted by the fill valve float mechanism, the auxiliary actuator comprising:

a plunger slidably and vertically oriented under the arm of the toilet fill valve to lift the arm sufficiently to close the toilet fill valve when the plunger is in a raised position, a hydraulic mechanism powered by water pressure from the toilet fill valve urging the plunger into the raised position;

a solenoid operated valve normally de-energized and adapted to block water pressure from the toilet fill valve, the solenoid operated valve when energized directing water pressure from the toilet fill valve to raise the plunger, thereby lifting the arm sufficiently to close the fill valve; and an electronic sensing circuit including at least one water level sensor for sensing the water level in the toilet tank, and a power source, the electronic sensing circuit electrically connected with the solenoid operated valve to energize the solenoid operated valve upon detection of a fault condition based on the input of the at least one water level sensor to close the toilet fill valve.

11. The auxiliary actuator of claim 10 wherein the electronic sensing circuit further includes a control module, a circuit board, a reset switch, an audible warning device, and at least one LED indicator, whereby the audible warning device and the at least one LED indicator may be energized by the electronic sensing circuit to alert a user to the fault condition.

12. The auxiliary actuator of claim 10 wherein the electronic sensing circuit is programmed to detect a slow flush valve leak by observing over a predetermined period of time a repeating pattern of the water level decreasing relatively slowly compared with a regular flush of the toilet, and then increasing as the fill valve refills the toilet tank, whereby a fault condition is established and the electronic sensing circuit energizes the solenoid operated valve.

13. The auxiliary actuator of claim 10 wherein one of the at least one sensors is a water level sensor for sensing the water level in the toilet tank, the electronic sensing circuit programmed to detect a stuck-open flush valve by observing a low water level in the toilet tank over a predetermined period of time, whereby a fault condition is established and the electronic sensing circuit energizes the solenoid operated valve.

14. The auxiliary actuator of claim 10 wherein one of the at least one sensors is a water level sensor for sensing the water level in a toilet bowl, the electronic sensing circuit programmed to detect a toilet bowl high water level fault by observing a high water level in the toilet bowl, whereby a fault condition is established and the electronic sensing circuit energizes the solenoid operated valve.

15. The auxiliary actuator of claim 10 wherein one of the at least one sensors is a water level sensor for sensing the water level in the toilet tank, the electronic sensing circuit programmed to detect a high water level fault by observing a continuous high water level in the toilet tank, whereby a fault condition is established and the electronic sensing circuit energizes the solenoid operated valve.

16. The auxiliary actuator of claim 11 wherein the control module further includes an external port, and wherein the electronic sensing circuit is adapted to set an indication of the type of fault condition on the external port, whereby an external alarm system connected to the external port may be utilized to alert a user to the fault condition.

17. The auxiliary actuator of claim 16 wherein the external port includes a wireless transmitter for wirelessly transmitting an indication of the fault condition to an external alarm system.

18. The auxiliary actuator of claim 12 wherein the power source is an AC adapter powered by line voltage.

* * * * *